United States Patent [19]

Ford

[11] Patent Number: 4,505,789

[45] Date of Patent: Mar. 19, 1985

[54] DYNAMIC GAS DISENGAGING APPARATUS AND METHOD FOR GAS SEPARATION FROM ELECTROLYTE FLUID

[75] Inventor: James M. Ford, Cleveland, Tenn.

[73] Assignee: Olin Corporation, Cheshire, Conn.

[21] Appl. No.: 561,427

[22] Filed: Dec. 14, 1983

Related U.S. Application Data

[63] Continuation-in-part of Ser. No. 334,943, Dec. 28, 1981, abandoned.

[51] Int. Cl.[3] ..... C25B 1/08; C25B 1/26; C25B 15/08; C25B 9/00

[52] U.S. Cl. ..... 204/128; 204/129; 204/237; 204/258; 204/266; 204/270; 55/52; 55/204

[58] Field of Search ..... 204/237, 256, 258, 266, 204/270, 129, 128; 55/204, 52

[56] References Cited

U.S. PATENT DOCUMENTS

| | | | |
|---|---|---|---|
| 1,738,372 | 12/1929 | Edgeworth-Johnstone | 204/237 |
| 2,075,688 | 3/1937 | Zdansky | 204/256 |
| 2,695,874 | 11/1954 | Zdansky | 204/258 |
| 2,762,451 | 9/1956 | McNeil | 55/204 |
| 3,007,542 | 11/1961 | Giampapa et al. | 55/52 |
| 3,163,508 | 12/1964 | Tuck et al. | 55/52 X |
| 3,785,951 | 1/1974 | Fleck | 204/268 |
| 3,812,655 | 5/1974 | Bennett | 55/204 |
| 3,928,150 | 12/1975 | Rahn et al. | 204/98 |
| 4,032,424 | 6/1977 | Peters et al. | 204/258 |
| 4,097,358 | 6/1978 | Wiseman | 55/204 |
| 4,217,199 | 8/1980 | Cunningham | 204/256 |
| 4,367,078 | 1/1983 | Hendrix | 55/204 X |
| 4,390,351 | 6/1983 | Matsui et al. | 55/204 |
| 4,397,735 | 8/1983 | Dilmore et al. | 204/129 |
| 4,399,321 | 7/1983 | Kircher | 204/258 |
| 4,428,839 | 1/1984 | Davies et al. | 55/204 X |

FOREIGN PATENT DOCUMENTS

| | | | |
|---|---|---|---|
| 1123321 | 8/1968 | United Kingdom | 204/98 |
| 543427 | 3/1977 | U.S.S.R. | 55/204 |
| 556839 | 9/1977 | U.S.S.R. | 55/204 |

*Primary Examiner*—Donald R. Valentine
*Attorney, Agent, or Firm*—Ralph D'Alessandro; Donald F. Clements; Thomas P. O'Day

[57] ABSTRACT

In an electrolytic cell there is provided an improved gas-liquid disengager design which employs an arcuate interior periphery in conjunction with the existing kinetic energy of the electrolyte fluid as the fluid exits the electrolysis compartment of each electrode and enters the disengager along a predetermined path of flow that is tangential to the internal periphery to disengage the electrolytic product gas more efficiently in a compact gas-liquid disengager.

15 Claims, 5 Drawing Figures

DYNAMIC GAS DISENGAGING APPARATUS AND METHOD FOR GAS SEPARATION FROM ELECTROLYTE FLUID

BACKGROUND OF THE INVENTION

This application is a continuation-in-part of application Ser. No. 334,943, filed Dec. 28, 1981, now abandoned, entitled "Dynamic Disengaging Means".

The present invention relates generally to the separation of product gas from the electrolyte fluid in the electrolyte circulation system utilized in electrolytic cells to circulate electrolyte fluid from the electrodes to the gas-liquid disengagers. More specifically, the present invention relates to an improved external gas-liquid disengager which is connected to each electrode via risers that define a path of flow for the electrolyte fluid that is tangential to the arcuate internal periphery of the disengager and which employs the kinetic energy of the electrolyte fluid and its entrained gas to promote separation of the entrained gas. The present invention also minimizes the gas that must flow through the liquid in the gas-liquid disengager to thereby reduce the possibility of gas entrainment.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known an chloralkali cells. The chloralkali cells today are generally of two principal types, the deposited asbestos diaphragm-type electrolytic cell or the flowing mercury cathode-type.

The development of a hydraulically impermeable membrane has promoted the advent of filter press membrane chloralkali cells which produce a relatively uncontaminated caustic product. This higher purity product can obviate the need for caustic purification and concentration processing. The use of a hydraulically impermeable planar membrane has been most common in bipolar filter press membrane electrolytic cells. However, advances continue to be made in the development of monopolar filter press membrane cells.

Prior gas-liquid disengagers utilized in conjunction with electrolytic cells typically have utilized larger, and therefore more costly, disengagers to increase the available separation area until satisfactory gas-liquid separation was obtained. There was a tendency toward foaming, as a result of the turbulence created by the release of the product gas bubbles from the electrolyte fluid, especially in larger disengagers. This foaming was especially troublesome during cell start-ups. Additionally, the product gas re-entrained in the foam formed from this frothing of the electrolyte, especially where the path of the electrolyte fluid in the disengager crossed the rising path taken by the product bubbles enroute to the gas discharge pipe. Also, by increasing the area of the gas-liquid disengagers, the profile or the height of the overall cell was increased.

The foregoing problems are solved in the design of the apparatus comprising the present invention wherein a dynamic gas-liquid disengager with an arcuate interior periphery employs centrifugal force and the kinetic energy of the electrolyte as the electrolyte exits the electrolytic compartment and enters the disengager to promote more efficient gas separation in a more compact disengager.

SUMMARY OF THE INVENTION

It is a principal object of the present invention to provide in an electrolytic cell utilizing an external gas-liquid disengager an improved gas-liquid disengager that employs an arcuate interior periphery in conjunction with the kinetic energy of the electrolyte fluid to promote efficient separation of the product gas therefrom.

It is another object of the present invention to provide an improved gas-liquid disengager that disenages the electrolytic product gases from the electrolyte fluid more efficiently without producing excessive foaming.

It is another object of the present invention to provide an improved gas liquid disengager that is compact in design.

It is a feature of the present invention that the gas-liquid disengager employs at least an interior periphery that is arcuate.

It is another feature of the present invention that the predetermined path of the electrolyte fluid as it enters the gas-liquid disengager is tangential to the arcuate interior periphery.

It is another feature of the present invention that the gas-liquid disengager may be horizontally oriented with respect to the assembled electrolytic cell.

It is a further feature of the present invention that the gas-liquid disengager employs a gas discharge pipe that extends horizontally within the gas-disengager and which has at least a first opening of predetermined width along its length to permit separated product gas to enter and be conveyed out of the disengager.

It is yet another feature of the present invention that the gas discharge pipe has at least a second opening in its lowermost portion to permit any electrolyte liquid that may be therein to flow out of the pipe back into the disengager.

It is still another feature of the design of the present invention that the liquid in the electrolyte fluid is maintained generally about the perimeter of the gas-liquid disengager and the gas is thereby permitted to enter the gas discharge pipe without passing through electrolyte fluid.

It is an advantage of the present invention that the gas-liquid disengager employs a dynamic concept to accomplish disengaging of the electrolytic product gas from the electrolytic fluids without the use of a large surface area and a vessel with a large volume capacity.

It is another advantage of the present invention that the kinetic energy of the electrolyte fluid and the entrained electrolytic product gas is employed to promote the separation of the product gas from the fluid.

It is a further advantage that the design of the present invention avoids having product gas flow through the electrolyte fluid in the disengager to thereby minimize the possibility of gas entrainment in the fluid within the disengager.

It is yet another advantage of the present invention that a more cost effective, compact design is employed which uses fewer materials and a smaller gas-liquid disengager area.

It is yet another advantage of the present invention that the gas-liquid disengager of the instant design helps provide a lower profile or height cell.

It is still another advantage of the present invention that a stronger gas-liquid disengager is achieved which is able to withstand greater internal pressures with thinner disengager walls.

These and other objects, features, and advantages are obtained in an electrolytic cell by providing an improved gas-liquid disengager design which employs an arcuate interior periphery in conjunction with the existing kinetic energy of the electrolyte fluid as the fluid exits the electrolysis compartment of each electrode and enters the disengager along a predetermined path of flow that is tangential to the internal periphery to disengage or separate the electrolytic product gas more efficiently in a compact gas-liquid disengager.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

It is to be understood that the filter press membrane cell described in the instant disclosure includes a plurality of electrodes. The electrodes are anodes and cathodes arranged in alternating sequence as will be described in greater detail hereafter. The term "anode" or "cathode" is intended to describe the entire electrode unit which is comprised of a frame which encases the periphery of the appropriate electrode and on opposing sides has anodic or cathodic surfaces, as appropriate, attached thereto. The space within the individual electrode between the electrode surfaces comprises the major portion of the compartment through which the anolyte or catholyte fluid, as appropriate, passes during the electrolytic process. The particular electrode compartment is defined by the pair of membranes that are placed adjacent, but exteriorly of each electrode's two opposing surfaces, thereby including both electrode surfaces within each compartment. The term "anode" and "cathode" is further intended to encompass the electrical current conductor rods that pass the current through the appropriate electrode, as well as any other elements that comprise the entire electrode unit.

Figure 1:
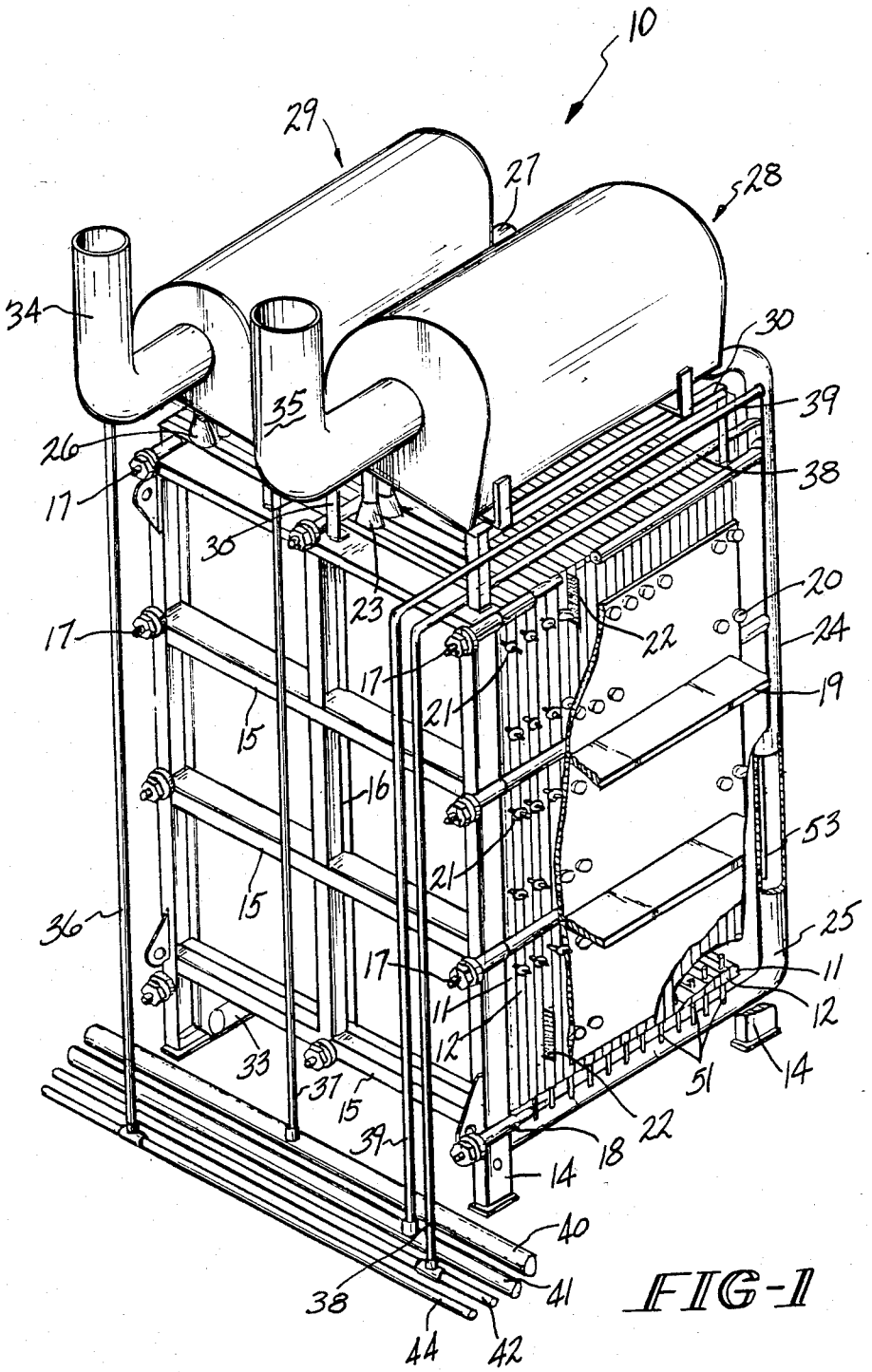
FIG. 1 is a side perspective view of a monopolar filter press membrane chlor-alkali electrolytic cell employing gas-liquid disengagers of the present invention with appropriate portions broken away to illustrate the main cell components.

Referring to FIG. 1, a filter press membrane cell, indicated generally by the numeral 10, is shown in a side perspective view. It can be seen that cathodes 11 and anodes 12 alternate and are oriented generally vertically. The cathodes 11 and anodes 12 are supported by vertical side frame members 14, horizontal side frame members 15, and intermediate vertical side frame members 16 (only one of which is shown). The cathodes 11 and anodes 12 are pressed together and secured by a series of tie bolts 17 which are inserted through appropriate mounting means affixed to the vertical side frame members 14 and horizontal side frame members 15. To prevent short circuiting between the electrodes during the electrolytic process, the tie bolts 17 have tie bolt insulators 18 through which the tie bolts 17 are passed in the area of the cathodes 11 and anodes 12.

Electrical current is passed, for example, from an external power source through the anode bus and then via anode bus nuts into the anode conductor rods, all not shown. From that point, the anode conductor rods pass the current into the anode surfaces, also not shown. The current continues flowing through the membrane 22, through the opposing cathode surfaces (not shown), the cathode conductor rods 21 and cathode bus nuts 20 to the cathode bus 19 where it continues its path out of the cell. The anodic conducting means are present on the opposite side of the filter press membrane cell 10 from the cathodic conducting means. Ion-selective permeable membranes 22 are diagramatically shown in FIG. 1 to illustrate how each anode 12 and cathode 11 are separated by the membranes.

Figure 3:
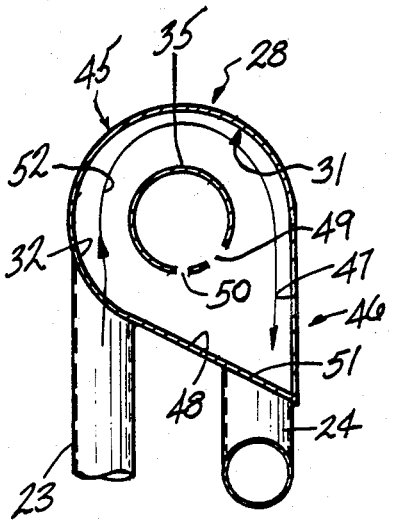
FIG. 3 is an end elevational cell view of one of the gas-liquid disengagers taken along the line 3—3 of FIG. 2.
Figure 2:
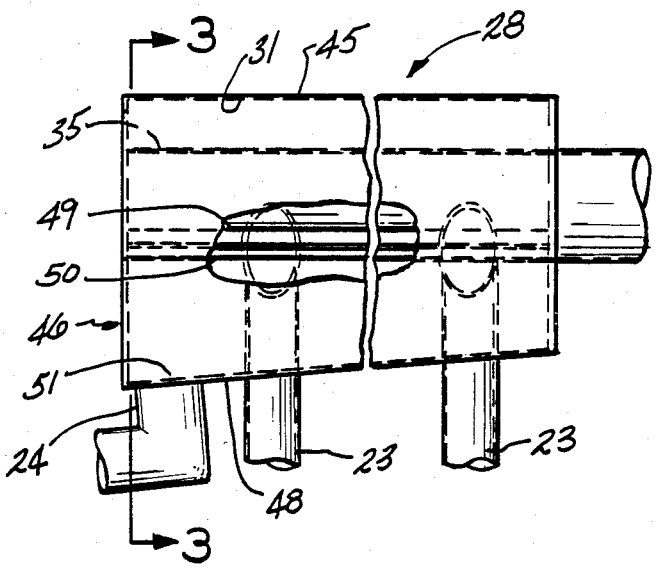
FIG. 2 is a partial side elevational view of one of the gas-liquid disengagers with a portion of the outer wall broken away.

Projecting from the top of anode 12 and cathode 11 are a series of anode and cathode risers used for fluid flow between the appropriate gas-liquid disengager and the corresponding electrode. FIGS. 1, 2, and 3 show anode risers 23, which project from the top of each anode 12. Similarly, cathode risers 26 project from the top of each cathode 11 in FIG. 1. The risers are generally utilized to carry the appropriate electrolyte fluid with the accompanying gas, either anolyte with chlorine gas or catholyte with hydrogen gas, to the appropriate disengager mounted atop the filter press membrane cell 10. FIG. 1 also shows the anolyte return conduit 24 that runs from the bottom of the anolyte gas-liquid disengager, indicated generally by the numeral 28, down to an anolyte manifold 25 which runs beneath the filter press cell 10. Similarly, the single catholyte return conduit 27 runs from the bottom of the catholyte gas-liquid disengager, indicated generally by the numeral 29, down to a catholyte manifold 33 that also runs beneath the filter press cell 10.

Anolyte disengager 28 and the catholyte disengager 29 are supported atop of the cell 10 by disengager supports 30. It is in each of these disengagers that the product gas is able to separate from the liquid of the anolyte or catholyte fluid, as appropriate, and is released from the appropriate disengager via either a cathode gas release or discharge pipe 34 or an anode gas release or discharge pipe 35 which extend from the appropriate end of the catholyte disengager 29 or anolyte disengager 28, respectively.

Also illustrated in FIG. 1 is the catholyte feed line 36 which carries deionized water in the single catholyte return conduit 27. The deionized water is appropriately fed into the recirculating reservoir of existing catholyte fluid which is recirculated from the catholyte disengager 29 to each cathode 11 in cell 10.

A catholyte outlet pipe 37 is also partially illustrated and serves to control the level of liquid in the catholyte disengager 29 by removing caustic to its appropriate processing apparatus.

An anolyte feed line 38 carries fresh brine into the anolyte return conduit 24 and is seen in FIG. 1. The fresh brine is then appropriately fed into the recirculating reservoir of existing anolyte fluid which is recirculated from the anolyte disengager 28 into each anode 12 in a manner that will be described in further detail hereinafter. An anolyte outlet pipe 39 is also shown and serves to control the level of liquid in the anolyte fluid within the anolyte disengager 28 by removing the spent brine for regeneration.

Also shown in FIG. 1 are the plurality of headers which run along the front of the bank of filter press cells. The bank of cells typically is formed by the side by side placement of individual filter press membrane cells 10. Caustic header 40 is connected to the catholyte disengager 29 via the catholyte outlet pipe 37. The spent brine or anolyte effluent header 41 is connected to the anolyte gas-liquid disengager 28 via anolyte outlet pipe 39. Fresh brine flows within the brine header 42 and via the anolyte feed line 38 into the recirculation system for the cell 10. The deionized water flows in the deionized water header 44 and passes via the catholyte feed line 36 to the recirculation system for the cathodes 11 and the catholyte gas-liquid disengager 29.

Although not shown in FIG. 1, a hydrogen gas header is connected to the catholyte gas-liquid disengager 29 via the cathode gas release pipe 34. Similarly, a chlorine gas header, also not shown, is connected to the anolyte gas-liquid disengager 28 via the anode gas release pipe 35. The hydrogen gas header and the chlorine gas header generally overlie the bank of cells formed by the individual cells 10 and are connected to each adjacent cell 10 in the manner just described or in any other suitable fashion.

The filter press membrane cell 10 has been described only generally since the structure and the function of its central components are well known to one of skill in the art.

Referring now to FIGS. 2 and 3, an exemplary arrangement of the anolyte gas-liquid disengager 28, the anolyte return conduit 24 and other associated structure are seen in relation to each other. The anolyte gas-liquid disengager 28 is shown with the anode risers 23 extending upwardly from the top of the individual anodes 12 of FIG. 1 into the anolyte gas-liquid disengager 28. The anode risers 23 extend upwardly into the disengager 28 to define a predeterminted path of flow for the anolyte fluid that is generally tangential at the point of entry to the arcuate portion 32 of the internal periphery 31 of the anolyte gas-liquid disengager of FIG. 3. Exiting from the bottom of the anolyte gas-liquid disengager 28 is the anolyte return conduit 24.

FIGS. 2 and 3 show the anolyte gas-liquid disengager 28 in greater detail. It is to be understood, although not specifically shown, that a similar structural arrangement is employed for the catholyte gas-liquid disengager 29. The disengager 28 is generally cylindrical in shape being mounted atop the cell 10 generally horizontally via disengager supports 30. The disengager 28 has an external periphery, indicated by the numeral 45, which is cylindrical except for the angled or sloped lower portion, indicated generally by the numeral 46. Angled lower portion 46 leads to the anolyte return conduit 24 and is sloped to promote the runoff of the liquid anolyte from the back of the disengager 28 forwardly into conduit 24. The internal periphery 31 is generally arcuate with the exception of that portion comprising the angled lower portion 46. Angled lower portion 46 is comprised of a generally vertical wall section 47 that extends tangentially downwardly from the arcuate portion 32 of the internal periphery to intersect with the sloped portion 48 that extends tangentially outwardly from the opposing side of the arcuate portion 32.

As best seen in FIGS. 2 and 3, the disengager 28 is mounted so that it is positioned generally horizontally with the anolyte gas release or discharge pipe 35 running horizontally therethrough. Gas release pipe 35 on the one end exits the disengager 28 and connects to the aforementioned chlorine gas header (not shown). The interior portion of the gas release pipe 35 has a gas discharge opening 49 running along substantially its entire length that is approximately ½ inch in width. This opening 49 permits the separated gas to enter the pipe and be conveyed out of the disengager via the gas release pipe 35. An anolyte liquid drain slot 50 is best seen in FIG. 3 and extends substantially the entire length of the internal portion of the gas release pipe 35 along its bottommost portion. Drain slot 50 is approximately ¼ inch in width along its entire length and is provided to permit any anolyte liquid that may have entered the gas release pipe 35 to exit the pipe and flow back into the disengager.

The end of the disengager 28 opposite from which gas release pipe 35 exits has an opening 51 along its bottommost portion to permit the anolyte liquid to enter the anolyte return conduit 24 for replenishment and recirculation about the cell 10. As best seen in FIG. 3, the opening 51 is located at the lowermost portion of the internal periphery 31 of the gas-liquid disengager 28 to permit the anolyte liquid to flow by force of gravity thereinto. The replenishment of the anolyte occurs in a manner that will be described hereafter.

It should be noted that although not shown and described in detail herein, the catholyte disengager 29 employs essentially the same design as that described and shown for the anolyte disengagers.

The anolyte feed line 38 in FIG. 1 is seen entering the single anolyte return conduit 24 below the anolyte gas-liquid disengager 28. The anolyte feed line 38 extends a predetermined distance down into the anolyte return conduit 24 via an internal portion 53 to a point above where the return conduit 24 meets the anolyte manifold 25, as is partially shown in cutaway in FIG. 1. The internal portion 53 of the anolyte feed line 38 is of the same diameter as the portion of the anolyte feed line 38 that is external to the anolyte return conduit 24 and is of sufficiently small cross-section to minimize electrical conductivity of the electrolyte flowing within it. The long length of the internal portion 53 of anolyte feed line 38 within the anolyte return conduit 24 provides high electrical resistance to the leakage of current from the cell through the feed line. The release of the stream of concentrated feed brine into the recirculating electrolyte at this particular point within the recirculation system effects thorough mixing of the replenished brine and the electrolyte prior to the mixed solution's entering the individual anodic electrolytic compartments.

A similar feed arrangement of the deionized water into the catholyte return conduit 27 from the catholyte feed line 36 also may be employed. The catholyte feed line 36 of FIG. 1 enters the catholyte return conduit 27 below the catholyte gas-liquid disengager 29. The internal portion (not shown) of catholyte feed line 36 extends down into the catholyte return conduit 27 a predetermined distance to a point just above where the return conduit 27 meets the catholyte manifold 33 (also not shown). Similarly to the anolyte portion of the recirculation system, the interhal portion (not shown) is of the same diameter as the portion of the catholyte feed line 36 external to the electrodes and disengager 29. The exiting of the feed deionized water into the large diameter stream of low resistance catholyte fluid at this point permits thorough mixing of the feed deionized water and the catholyte fluid prior to the mixed solution's entering the individual cathodic electrolytic compartments.

The appropriate electrolyte, thoroughly mixed with the feed from the appropriate feed line, passes from the return conduit into the appropriate manifold, and then into the appropriate electrode via feed pipes. As seen in FIG. 1, the anolyte manifold 25 connects via anode feed pipes 51 to the individual anodes 12. These feed pipes 51 permit the anolyte fluid to enter the bottom of the individual anodes 12 through the anode frames so that a full recirculation loop is effected. Similarly, although not specifically shown, it is to be understood that the catholyte manifold 33 is connected by feed pipes to the individual cathodes 11, thereby permitting the recycled catholyte fluid to enter the bottom of the individual cathodes 11 through the cathode frames. This closes the catholyte fluid recirculation loop of fluid flowing from the catholyte disengager 29 through the catholyte return conduit 27 to the catholyte manifold 33.

Anolyte outlet pipe 39 is connected in FIG. 1 to the anolyte gas-liquid disengager 28 via the anolyte return conduit 24. On its opposing end outlet pipe 39 is connected to the anolyte effluent header 41. Catholyte outlet pipe 37, partially shown in FIG. 1, is similarly connected to the catholyte gas-liquid disengager 29 via catholyte return conduit 27.

The anolyte feed pipe 38 and the catholyte feed line 36 preferably are made from corrosion resistant, nonconductive materials. Feed pipe 38 may be constructed from polyvinylidene chloride (PVDC), chlorinated polyvinyl chloride (CPVC), polyfluorotetrafluoroethylene Teflon®), or other appropriate materials, such as titanium. Feed line 36 may be made of CPVC or other appropriate materials, such as nickel.

In operation, a filter press membrane cell 10 has an electric current from an external power source conducted via an anode bus, anode bus bolts and anode conductor rods into the surfaces of each anode 12. The electrical current passes through the membrane 22 and is conducted via the surfaces of each cathode 11 to the cathode conductor rods 21, the cathode bus bolts and then the cathode bus 19 from where it continues its path of flow. Electrolyte fluid, principally a salt brine, is fed from the brine header 42 via the anolyte feed line 38 into the anolyte return conduit 24, the anolyte manifold 25 and then into each anode 12 via the anode feed pipes 51. The anolyte fluid passes from each anode 12 into the anolyte disengager 28 via the anode risers 23. The anolyte recirculation loop is completed by having the anolyte fluid exit the anolyte disengager 28 into the anolyte return conduit 24.

A fluid for feeding the catholyte fluids, such as deionized water, is fed through the deionized water header 44 to the catholyte feed line 36 into the catholyte return conduit 27, the catholyte manifold 33 and then via cathode feed pipes (not shown) into each cathode 11. The catholyte fluid with the now mixed deionized water rises up through the individual cathodes 11 into the catholyte disengager 28 through the cathode risers 26. The catholyte loop portion of the recirculation system is completed by having the catholyte fluid exit the catholyte disengager 29 into the catholyte return conduit 27.

The electrolytic process within the cell causes the freeing of chlorine from the salt brine and hydrogen from the deionized water. The chlorine rises as entrained gas with the anolyte fluid through the anode risers 23 into the anolyte disengager 28 along a predetermined path of flow that is tangential to the arcuate portion 32 of the internal periphery 31. The kinetic energy of the anolyte fluid as it enters the anolyte disengager 28 is utilized to promote the separation of the entrained chlorine gas from the anolyte fluid. In the cathodes 11, the hydrogen gas moves with the catholyte fluid, including the appropriate caustic, upwardly through the cathode risers 26 into the catholyte disengager 29, entering along a predetermined path of flow that is tangential to the arcuate portion of the internal periphery (both not shown) of the catholyte disengager 29. The kinetic energy of the catholyte fluid as it enters the catholyte disengager 29 is also used to promote the separation of the entrained hydrogen gas from the catholyte fluid.

This separation of the product gas from the appropriate electrolyte fluid is accomplished by the entry of the fluid tangentially to the appropriate disengager's arcuate periphery. This tangential entry path permits the fluid to follow the arcuate internal periphery. The centrifugal force of the fluid as it moves inside its disengager keeps the liquid phase of the fluid on the outside of the disengager so that it generally follows the liquid path in each disengager indicated generally by the numeral 52 in FIG. 3. The gas product, chlorine in the anolyte disengager 28 and hydrogen in the catholyte disengager, then can separate out from the liquid electrolyte as it follows the internal periphery of its disengager and enter the anolyte gas release pipe 35 or catholyte gas release pipe 34, as appropriate, through the anolyte gas discharge opening 49 or the catholyte gas discharge opening (not shown). The product gases then exit the appropriate disengager through the anolyte gas release pipe 35 or the catholyte gas release pipe 34 and pass into the chlorine header and hydrogen header, respectively (both not shown).

Any liquid that may have entered the anolyte gas release pipe 35 or the catholyte gas release pipe 34 during the separation process drains out of the appropriate pipe through the anolyte liquid drain slot 50 or the catholyte liquid drain slot (not shown) and flows back into the bottom of the disengager. Once the electrolyte fluid has completed its path about the internal periphery of the appropriate disengager, it enters the angled lower portion 46 of the anolyte disengager 28 and the angled lower portion (not shown) of the catholyte disengager 29 by flowing along the sloped portion 48 of the anolyte disengager's internal periphery 31 and the corresponding sloped portion (not shown) of the catholyte disengager 29, as appropriate. The liquid electrolyte then enters the appropriate return conduit, such as through opening 51, into anolyte return conduit 24 for the anolyte, to be recirculated and replenished prior to reentering the electrolytic compartments. In the catholyte disengager 29, the caustic is removed for appropriate processing via the catholyte outlet pipe 37. The brine and the deionized water are replenished within the recirculation system via the aforementioned anolyte feed line 38 and catholyte feed line 36, respectively.

The dynamic disengagers of the present design thus separate the product gas from the appropriate electrolyte fluid without having the product gases re-entrain in the foam formed from the frothing of the electrolyte fluid within the appropriate disengager in a generally passive separation process. The dynamic disengaging process disclosed herein minimizes the possibility of product gas remaining entrained within either the anolyte or catholyte liquid and substantially reduces the foaming that occurs within conventional disengagers. This dynamic disengaging or separation of the product gases from the electrolyte fluids permits the separation to occur in a smaller area disengager that is more cost effective because of the resultant decrease in the amount of material needed to construct the disengagers compared to conventional disengagers. The disengagers are also lower in height than conventional disengagers heretofore employed in electrolytic cells and, therefore, help to lower the overall height or profile of the cell 10. The arcuate internal periphery of each disengager also provides a design that is stronger and permits the individual disengagers to withstand greater internal operating pressures with thinner walls than are employed in conventional disengagers.

The disengagers 28 and 29 are fabricated from any corrosion resistant metal or plastic, such as polysulfone, and are sized according to the size of the cell 10 to which they are mounted. Additionally, the anolyte gas release pipe 35, as well as the catholyte gas release pipe 34, may be offset from the opposite end wall of the appropriate disengager from which it enters to permit separated product gas to enter the end of the appropriate gas release pipe as well as through the gas discharge opening.

It is to be understood that the gas-liquid disengagers employed in this invention could equally well be cylindrical or frustoconical in design provided the internal periphery provides an arcuate surface for electrolyte fluid to tangentially impinge thereon. The orientation of the gas-liquid disengagers need not be limited to horizontal.

Figure 4:
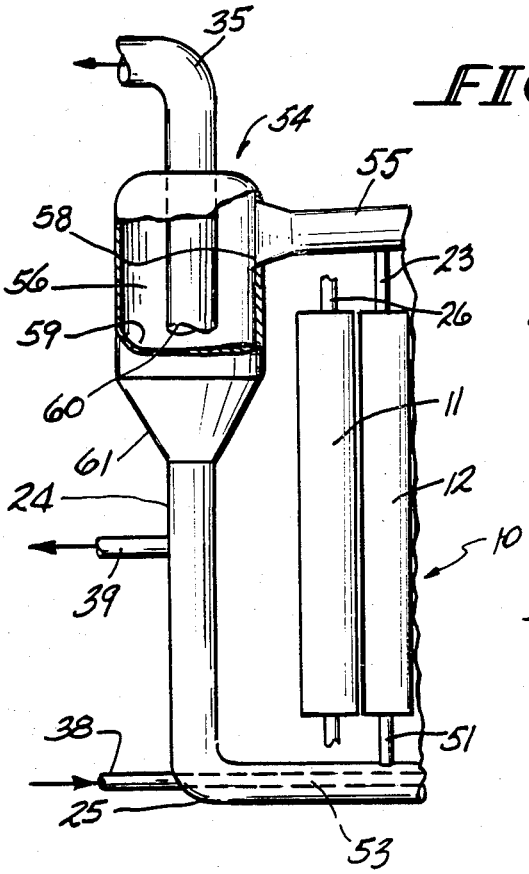
FIG. 4 is a side elevational view of an alternative embodiment of the gas-liquid disengager that is oriented vertically with the predetermined path of electrolyte flow into the disengager being tangential to the arcuate interior periphery.
Figure 5:
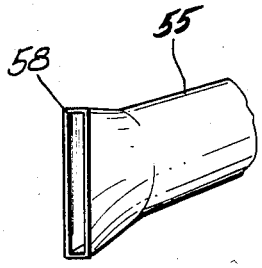
FIG. 5 is a perspective view of the exit port in the discharge manifold feeding electrolyte into the disengager of FIG. 4.

The alternative embodiment shown in FIG. 4 presents a generally vertically oriented anolyte gas-liquid disengager, indicated generally by the numeral 54, that is shown connected to a portion of a cell 10. Anode risers 23 extend from the top of the anodes 12, only one of each being shown, to connect with a discharge manifold 55. Manifold 55 is sloped downwardly towards the anolyte gas-liquid disengager 54 to promote the runoff of the electrolyte into the interior 56 of the disengager 54. The exit port 58 of the discharge manifold 55 is positioned so that the predetermined path of flow of the electrolyte fluid as it enters the disengager 54 is tangential to the arcuate internal periphery 59. The centrifugal force of the anolyte fluid as it travels about the arcuate internal periphery 59 promotes the separation of the chlorine gas from the anolyte fluid. The separated gas exits the disengager 54 via the anolyte gas discharge or relief pipe 35 enroute to the chlorine header.

The opening or entrance port 60 in the gas discharge pipe 35 is positioned below the exit port 58 of the discharge manifold 55. The diameter of the gas discharge pipe 35 is substantially the same size as the diameter of the discharge manifold 55. The exit port 58 of the discharge manifold 55 feeding into the disengager 54 is located as high in the disengager 54 as is practical so that the tangential feed of electrolyte and entrained gas will cause the electrolyte to flow in a spiral path that is as long as possible down the walls or arcuate internal periphery 59 of the disengager 54. This long spiral path of travel maximizes the disengaging of the gas from the electrolyte. The exit port 58 is flattened to present an elongate opening that increases the height of the tangential entry path and the entry velocity of the fluid.

The central positioning within the disengager 34 of the gas discharge pipe 35 serves as a physical block to the inlet electrolyte fluid and further helps promote the flow of the electrolyte fluids in a spiral path about the disengager. This spiral flow path permits the separation of the gas from the liquid to be essentially complete near the bottom of the disengager so that the electrolyte liquid is in a thin sheet at the bottom of the disengager and the disentrained or separated gas is free to rise upwardly into the entrance port 60 of the gas discharge pipe 35.

The anolyte liquid travels down the anolyte return conduit 24 where the depleted anolyte effluent is removed via the anolyte outlet pipe 39. An anolyte or brine feed line 38 enters the anolyte manifold 25 and carries fresh brine into the manifold 25 where it is mixed with the existing anolyte fluid prior to being transported up into the individual anodes 12.

The flattened exit port 58 permits the electrolyte to enter the disengager 54 with increased velocity. This permits a balance to be achieved to obtain the optimum gas-liquid separation since a high pressure difference or drop promotes gas-liquid separation and a low pressure difference or drop reduces the gas-liquid separation. Flattened exit port 58 can either terminate at the periphery or entrance to the disengager 54 or may extend a predetermined distance inside the disengager 54.

The transition area 61 of the disengager 54 is shown as being conical, connecting the disengager 54 with the anolyte return line 24. The purpose of this area 61 is to serve as a transition piece from the larger diameter of the disengager 54 to the smaller diameter of the anolyte return line or pipe 24. Any other suitably shaped transition piece connecting the bottom of the disengager 54 to the anolyte return line 24 may be employed.

The same general structural arrangement is employed for the catholyte disengager (not shown), permitting it to be oriented generally vertically.

While the preferred structure in which the principles of the present invention have been incorporated is shown and described above, it is to be understood that the invention is not to be limited to the particular details thus presented, but in fact, widely different means may be employed in the practice of the broader aspects of this invention. For example, although the primary use for the invention disclosed herein is in conjunction with a filter press membrane chloralkali cell, it is to be understood that the same method and equipment are suitable for other types of chloralkali cells such as diaphragm or mercury cells, as well as any other type of electrolytic cell which must separate a gas from liquid. The scope of the appended claims is intended to encompass all obvious changes in the details, materials and arrangement of parts which will occur to one of skill in the art upon a reading of the disclosure.

What is claimed is:

1. In a filter press membrane cell for the production of chlorine and hydrogen gas and a caustic having a plurality of electrodes connected to an electrical power source and contained within frame means, external electrolyte disengager means in fluid flow communication with each electrode via electrode risers and electrolyte return conduit means, electrolyte feed replenisher means connected to the conduit means through which electrolyte fluid flows, the improvement comprising in combination:

(a) improved disengager means connected to the cell and positioned generally horizontally having an internal periphery that is at least partially arcuate with an inlet through which to receive the electrolyte fluid such that the inlet is positioned with respect to the at least partially arcuate internal periphery so that the flow of electrolyte fluid as it enters the disengager means is along a predetermined path which is generally tangential to the at least partially arcuate internal periphery; and (b) discharge means positioned generally horizontally and at least partially within the disengager means for conveying product gas from the disengager means.

2. The apparatus according to claim 1 wherein the discharge means is positioned generally horizontally within the disengager means extending from a first end transversely to a second end.

3. The apparatus according to claim 2 wherein the discharge means further has at least a first opening extending transversely at least partially between the first end and the second end to permit separated gas product to enter and be conveyed out of the disengager means.

4. The apparatus according to claim 3 wherein the discharge means further has at least a second opening extending at least partially transversely between the first end and the second end below the first opening to permit electrolyte liquid that may have entered the discharge means to flow back into the disengager means.

5. The apparatus according to claim 4 wherein the internal periphery of the disengager means further includes an angled lower portion that extends from a first location adjacent the first end to a second lower location adjacent to the second end, the second lower location having an opening therethrough to permit electrolyte fluid to flow from the first location to the second lower location and into the electrolyte return conduit means.

6. The apparatus according to claim 5 wherein the angled lower portion of the internal periphery of the disengager means further comprises a sloped portion that extends from a level adjacent the electrode risers downwardly toward the second lower location's opening.

7. The apparatus according to claim 6 wherein the disengager means is an anolyte disengager.

8. The apparatus according to claim 6 wherein the disengager means is a catholyte disengager.

9. In a filter press membrane electrolytic cell for the production of at least a product gas, the cell containing electrolyte fluids which move along a predetermined path of flow, comprising in combination;

(a) frame means to support the cell;

(b) a plurality of adjacently positioned electrodes supported by the frame means, each electrode having two opposing surfaces;

(c) a plurality of hydraulically impermeable ion-selective membranes positioned between each two adjacently positioned electrodes to control the flow of ions and fluid thereacross;

(d) an electrode riser connected to each electrode adapted to convey electrolyte fluids out of the electrode along the predetermined path of flow;

(e) horizontally positioned disengager means external to each electrode and in fluid flow communication therewith for the separation of gas from the electrolyte fluid contained therein, the disengager means further having an internal periphery that is at least partially arcuate with an inlet through which to receive the electrolyte fluid, the inlet being positioned with respect to the arcuate internal periphery such that the predetermined path of flow of the electrolyte fluid as the fluid enters the disengaging means is generally tangential to the arcuate internal periphery to effect the separation of the liquid phase from the gas of the electrolyte fluid by the centrifugal force of the electrolyte fluid as the fluid follows the at least partially arcuate internal periphery;

(f) horizontally positioned discharge means connected to the disengager means and located at least partially therewithin for conveying product gas from the disengager means; and (g) electrolyte return conduit means in fluid flow communication with the disengager means and the individual electrodes to recirculate electrolyte fluid from the disengager means to the electrode.

10. The apparatus according to claim 9 wherein the discharge means is positioned generally horizontally within the disengager means extending from a first end transversely to a second end.

11. The apparatus according to claim 10 wherein the discharge means further has at least a first opening extending transversely at least partially between the first end and the second end to permit separated gas product to enter and be conveyed out of the disengager means.

12. The apparatus according to claim 11 wherein the discharge means further has at least a second opening extending at least partially transversely between the first end and the second end below the first opening to permit electrolyte liquid that may have entered the discharge means to flow back into the disengager means.

13. The apparatus according to claim 12 wherein the internal periphery of the disengager means further includes an angled lower portion that extends from a first location adjacent the first end to a second lower location adjacent to the second end, the second lower location having an opening therethrough to permit electrolyte fluid to flow from the first location to the second lower location and into the electrolyte return conduit means.

14. The apparatus according to claim 13 wherein the angled lower portion of the internal periphery of the disengager means further comprises a sloped portion that extends from a level adjacent the electrode risers downwardly toward the second lower location's opening.

15. A method of separating product gas from an electrolyte fluid comprising the steps of:

(a) introducing the electrolyte fluid into generally horizontally positioned disengaging means along a generally vertical predetermined path of flow that is tangential to the arcuate internal periphery of the disengaging means;

(b) causing the electrolyte fluid to travel about the arcuate internal periphery using the centrifugal force of the electrolyte fluid to separate out the product gas so that the liquid phase of the electrolyte fluid remains adjacent the arcuate internal periphery of the disengaging means;

(c) removing the separated product gas in a generally horizontal flow path from the disengaging means by having the product gas enter a generally horizontally positioned gas stationary discharge means connected to and at least partially within the disengaging means; and (d) draining any liquid phase of the electrolyte fluid within the discharge means through at least one bottom opening prior to the liquid phase leaving the disengaging means.

* * * * *